US008146275B2

(12) United States Patent
Lee et al.

(10) Patent No.: US 8,146,275 B2
(45) Date of Patent: Apr. 3, 2012

(54) STEAM IRON

(75) Inventors: Chih-hwa Lee, Tainan (TW); Chien-Chih Pan, Tainan (TW)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 265 days.

(21) Appl. No.: 12/622,570

(22) Filed: Nov. 20, 2009

(65) Prior Publication Data

US 2010/0122478 A1 May 20, 2010

(30) Foreign Application Priority Data

Nov. 20, 2008 (CN) ..... 2008 1 0072197

(51) Int. Cl.
*D06F 75/26* (2006.01)
*D06F 75/18* (2006.01)

(52) U.S. Cl. ..... 38/77.7; 38/77.6

(58) Field of Classification Search ..... 38/77.7–77.83, 38/77.3, 77.6

See application file for complete search history.

(56) References Cited

U.S. PATENT DOCUMENTS

| | | | | |
|---|---|---|---|---|
| 4,414,037 | A * | 11/1983 | Friedheim | 134/35 |
| 6,786,182 | B2 * | 9/2004 | Morgandi et al. | 122/4 A |
| 7,805,867 | B2 * | 10/2010 | Har et al. | 38/77.7 |
| 2009/0151206 | A1 * | 6/2009 | Cai et al. | 38/1 C |

FOREIGN PATENT DOCUMENTS

| | | |
|---|---|---|
| CN | 2081850 | 7/1991 |
| JP | 2007313115 | * 12/2007 |

* cited by examiner

*Primary Examiner* — Ismael Izaguirre
(74) *Attorney, Agent, or Firm* — Rabin & Berdo, P.C.

(57) ABSTRACT

The present invention discloses a steam iron comprising a housing with a handle, a water container, a steam control device and a vapor chamber provided with an electric heating plate, wherein the steam control device comprising a pressure sensor mounted on the handle of said housing, a control board with a microprocessor and an execution unit for providing the water into said chamber or providing the vapor generated by a evaporator into said chamber for secondly heated; the execution unit is controlled by the control board by the pressure signal provided by said pressure sensor.

6 Claims, 4 Drawing Sheets

STEAM IRON

FIELD OF THE INVENTION

The present invention relates to an iron device, and more particularly, to a steam iron capable of adjusting the amount of spraying steam freely in ironing.

BACKGROUND OF THE INVENTION

The electrical iron of prior art comprises a housing with a handle, a water container and a steam control device are disposed inside the housing, an electric heating plate is disposed in the lower portion of the housing, and the housing is provided with a power switch and a control button of the steam control device. The steam control device is used for controlling the water in the container to flow to the electric heating plate to generate steam. The steam generating method of the prior iron can be divided into two ways: first one, spraying steam: i.e. the water in the container continuously drip on the electric heating plate by the steam control device, thus a few of steam is continuously generated and sprayed out continuously through the outlet of the electric heating plate 2, Second way, forceful spraying steam, or flash steam: i.e. the water in the container flow to the electric heating plate in a certain amount by the steam control mechanism, then large amount of steam generated in a short time sprayed out from the outlet of the electric heating plate abruptly. A CN utility model with the title of "Electric iron with forceful spraying steam" is disclosed in CN publication NO:2081850, application NO 91202225.6, in which the two ways of spraying steam are detailedly disclosed. However, the iron of the prior art has the following drawbacks: firstly, the amount and the duration time of the flash steaming can not be changed freely, if the user need large amount and continue steam in ironing corrugation, the iron of the prior art can not meet this requirement. Secondly, the controlling of generating forceful spraying steam need to press or rotate a special button, this is not fit for the operation requirement of the continue ironing.

SUMMARY OF THE INVENTION

The primary object of the present invention is to provide a steam iron capable of adjusting the amount and during time of the flash steam freely in continue ironing.

This object of the invention is achieved by providing: a steam iron comprising a housing with a handle, a water container, a steam control device and a vapor chamber provided with an electric heating plate; said steam control device comprising a pressure sensor mounted on the handle of said housing, a control board with a microprocessor and an pump for providing the water into said vapor chamber; said pump is controlled by said control board according to the pressure signal provided by said pressure sensor.

In a preferred embodiment of the present invention, said pump disposed inside said housing and provided with an inlet connected to said water container and an outlet connected to said first electric heating plate.

In another preferred embodiment of the present invention, said pump disposed inside an iron station and provided with an inlet connected to the water container and an outlet connected to said electric heating plate; said pump pumps the water in the water container to a second electric heating plate of the iron body via tube under the control of the control board.

The object of the present invention also can be achieved by providing: a steam iron comprising a housing with a handle, a water container, a steam control device, and a vapor chamber provided with a first electric heating plate; said steam control device comprising a pressure sensor mounted on the handle of said housing, a control board with a microprocessor and an execution unit providing the vapor into said vapor chamber to be secondly heated and sprayed out; said execution unit is controlled by said control board according to the pressure signal provided by said pressure sensor.

In another embodiment of the present invention, said execution unit comprises a pump and an evaporator, said pump pumps the water into said evaporator under the control of the control board for generating the steam and then said steam is transported to said electric heating plate via the steam tube to be secondly heated and sprayed out.

In a preferred embodiment of the present invention, said pump, said evaporator and said water container are disposed in the iron station;

In second embodiment, said water container is a boiler and said execution unit is an electromagnetic valve, said electromagnetic valve transport the steam generated in said boiler to said electric heating plate via the steam tube under the control of the control board and the steam is secondly heated and sprayed out.

In a preferred embodiment, said electromagnetic valve and said boiler are disposed inside said iron station.

The steam iron of the present invention is to mount a pressure sensor on the handle of the iron body which is under the palm, the user can touch the pressure sensor by adding the grasping force on the handle. The execution unit is controlled by the control board with microprocessor according to the pressure signal from the pressure sensor to transport the water in the water container to the electric heating plate so as to be heated to generate steam and sprayed out; Or the execution unit is controlled by the control board with microprocessor according to the pressure signal from the pressure sensor to transport the water in the water container to the electric heating plate so as to be secondly heated to generate steam and ejected out; The user can adjust the steam amount and spraying time freely in continue ironing, and doesn't need to stop the ironing to push the other button or rotate special knob, thus is facilitate to adjust the steam amount in continue ironing. Especially, if large amount of steam is needed when the user is ironing a relative big corrugation, it only need to press the pressure sensor on the handle by a certain pressure, then the iron device can add the steam amount automatically; thus the ironing is more user-friendly and more meet to the purpose of the user.

DETAILED DESCRIPTION OF THE PREFERRED EMBODIMENTS

Embodiment 1

Figure 1:
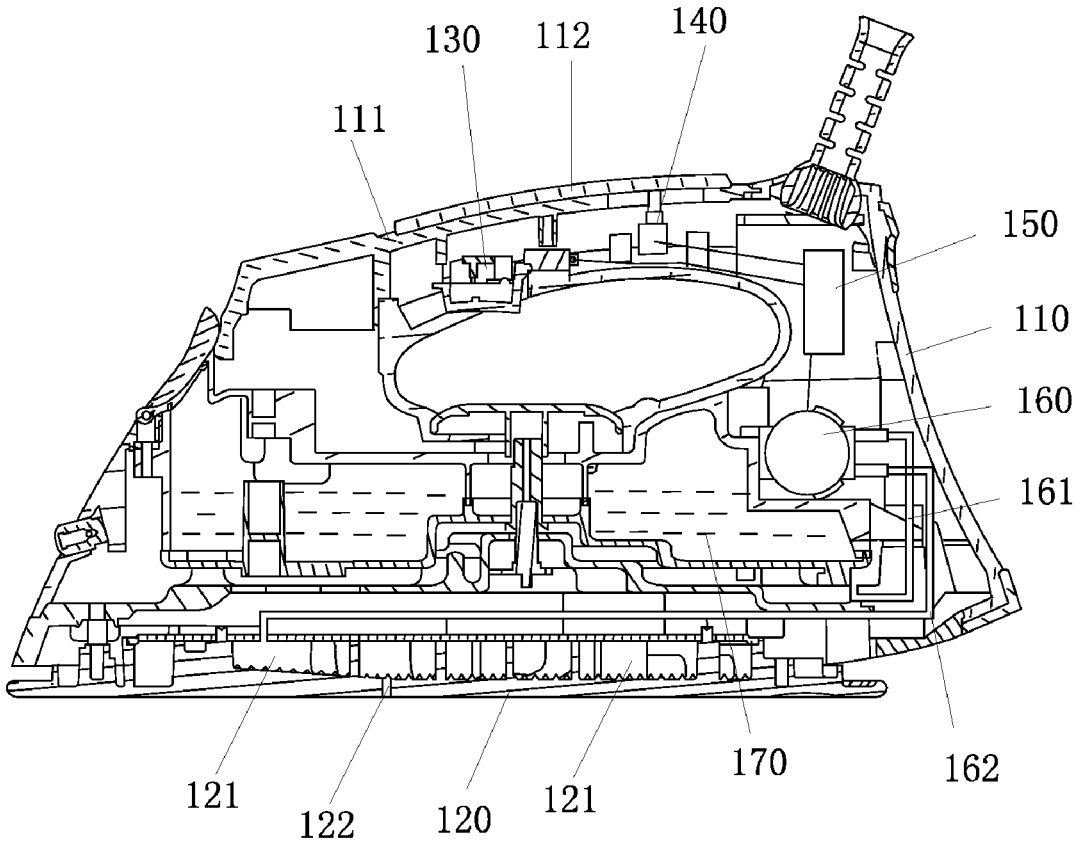
FIG. 1 is a sectional view of the steam iron in embodiment 1 of the present invention.

In this embodiment, the steam iron of the present invention is shown in FIG. 1, the lower portion of the housing 110 is provided with an electric heating plate 120. A power switch 130 is disposed on the handle 111 of the housing 110. The top surface of the handle 111 is provided with an opening and a cover 112 made of flexible material is dispose on the opening. A pressure sensor 140 is disposed beneath the opening in the handle 111. A control board 150 with microprocessor, a pump 160 and a container 170 are mounted inside the housing 110. the inlet 161 of the pump 160 is connected to the container 170, and the outlet 162 of the pump 160 is connected to the vapor chamber 121 upper the electric heating plate 120.

A steam control device is consisted of the pressure sensor 140, the control board 150 and the pump 160, in ironing, if forceful steam is needed, the user can press the cover 112 disposed in the opening of the handle 111 by palm. The cover 112 is pressed downwardly to press the pressure sensor 140, and the pressure sensor 140 will transmit a pressure signal of the pressing by the user to the control board 150, then the pump 160 is controlled by the control board 150 according to the strength and the continue time of the signal, and input the water in the container 170 into the vapor chamber 121 of the electric heating plate 120 proportionally so as to generate steam and spray the steam out from the outlet 122 of the electric heating plate 120.

The control board 150 provides control signal to the pump 160, for example, by frequency modulation; thus the control board 150 will provide a strengthened control signal frequency to the pump 160 if the pressure signal is strengthened suddenly, so that the steam amount can be added in a short time accordingly to get forceful steam.

Embodiment 2

Figure 2:
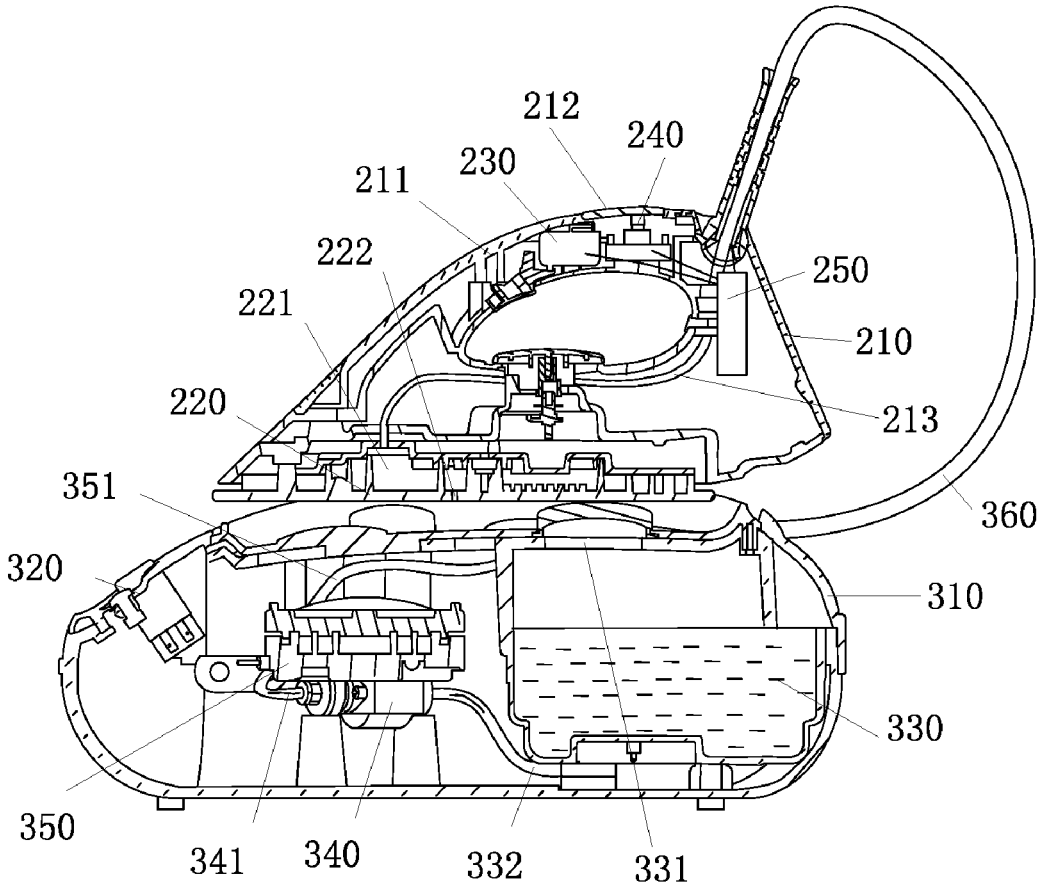
FIG. 2 is a sectional view of the steam iron in embodiment 2 of the present invention.

As is shown in FIG. 2, in this embodiment, the steam iron of the present invention is provided with an ironing station with evaporator, The lower portion of the housing 210 is provided with an electric heating plate 220. A power switch 230 is disposed on the handle 211 of the housing 210. the top surface of the handle 211 is provided with an opening and a cover 212 made of flexible material is dispose on the opening. A pressure sensor 240 is disposed beneath the opening in the handle 211. A control board 250 with microprocessor is disposed inside the housing 210 of the iron body.

A main power switch 320, a pump 340, a container 330 and an evaporator 350 are mounted inside the housing 310 of the iron station. The top of the container 330 is provided with an inlet 331 and the bottom of the container 330 is provided with a tube 332 which is connected to the inlet of the pump 340. The outlet 341 of the pump 340 is connected to the inlet of the evaporator 350. A tube 360 disposed between the iron station and the iron body contains a steam tube 213, a power cord and a signal cord inside. The steam tube 213 connected to the outlet 351 of the evaporator 350 of the iron station and the vapor chamber 221 of the electric heating plate 220 of the iron body. The power cord provides power to the switch 230 of the iron body from the main switch 320 of the iron station. The signal cord is connected between the control board 250 of the iron body and the pump 340 of the iron station.

A steam control device is consisted of the pressure sensor 240, control board 250, pump 340 and evaporator 350.

In ironing, if forceful steam is needed, the user can press the cover 212 disposed in the opening of the handle 211 by palm. The cover 212 is pressed downwardly to the pressure sensor 240, and the pressure sensor 240 will transmit a pressure signal of the press by the user to the control board 250, then the pump 360 is controlled by the control board 250 according to the strength and the continue time of the signal, and input the water in the container 330 to the vapor chamber 221 of the electric heating plate 220 so as to generate steam and spray the steam out from the outlet 222 of the electric heating plate 220.

The control board 250 provides control signal to the pump 340, for example, by frequency modulation; thus the control board 250 will provide a strengthened control signal frequency to the pump 340 if the pressure signal is strengthened suddenly, so that the working power of the pump 340 is added and more water can be pumped to the evaporator 350 from the container 330, therefore, the steam amount can be added in a short time accordingly to get forceful steam.

Embodiment 3

Figure 3:
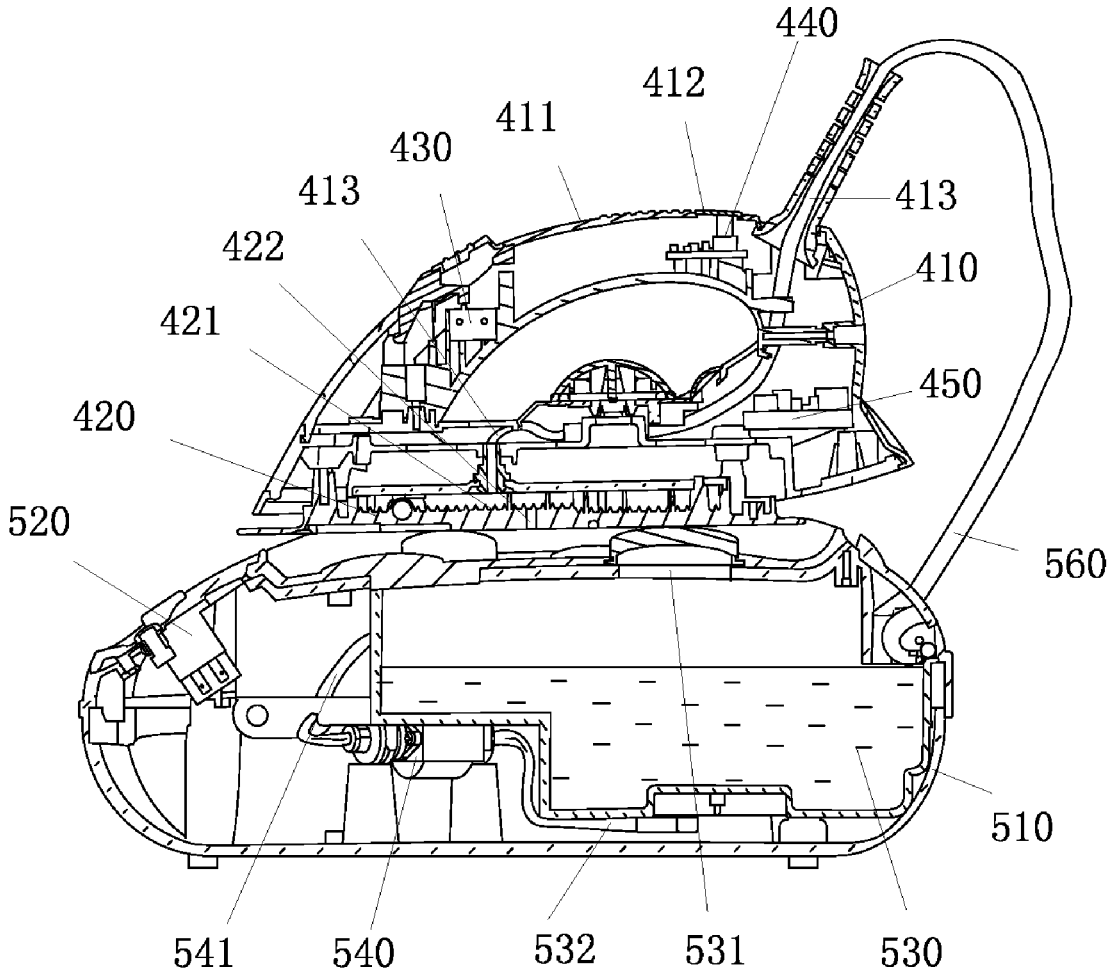
FIG. 3 is a sectional view of the steam iron in embodiment 3 of the present invention.

In this embodiment, the steam iron of the present invention is provided with an iron station with an additional container, referring to FIG. 3, The lower portion of the housing 410 is provided with an electric heating plate 420. A power switch 430 is disposed on the handle 411 of the housing 410. the top surface of the handle 411 is provided with an opening and a cover 412 made of flexible material is dispose on the opening. A pressure sensor 440 is disposed beneath the opening in the handle 411. a control board 450 with microprocessor is disposed inside the housing 410 of the iron body.

A main power switch 520, a pump 540, a container 530 are mounted inside the housing 510 of the iron station. The top of the container 530 is provided with an inlet 531; and the bottom of the container 530 is provided with a tube 532 which is connected to the inlet of the pump 540. A tube 360 disposed between the iron station and the iron body contains a water tube 413, a power cord and a signal cord inside. The water tube 413 connected the outlet 541 of pump 540 of the iron station with the vapor chamber 421 of the electric heating plate 420 of the electric heating plate 420 of the iron body. The power cord provides power to the power switch 430 of the iron body from the main power switch 520 of the iron station. The control signal from the 450 is transmit to the pump 540 of the iron station by the signal cord.

A steam control device is consisted of the pressure sensor 440, control board 450 and pump 540.

In ironing, if forceful steam is needed, the user can press the cover 412 disposed in the opening of the handle 411 by palm, then the cover 412 is pressed downwardly to the pressure sensor 440, and the pressure sensor 440 will transmit a pressure signal of the press by the user to the control board 450, the pump 540 is controlled by the control board 450 according to the strength and the continue time of the signal, and input the water in the container 530 to the vapor chamber 421 of the electric heating plate 420 so as to generate steam and spray the steam out from the outlet 422 of the electric heating plate 420.

The control board 450 provides control signal to the pump 540, voltage or current control can be used besides the frequency control used in the afore two embodiment, for example, voltage control is used to control the pump, then the control board 450 will provide a strengthened voltage control signal to the pump 540 if the pressure signal is strengthened suddenly, so that the working power of the pump 540 is added and more water can be pumped to the evaporator 350 from the container 530, therefore the steam amount can be added in a short time to get forceful steam.

Embodiment 4

Figure 4:
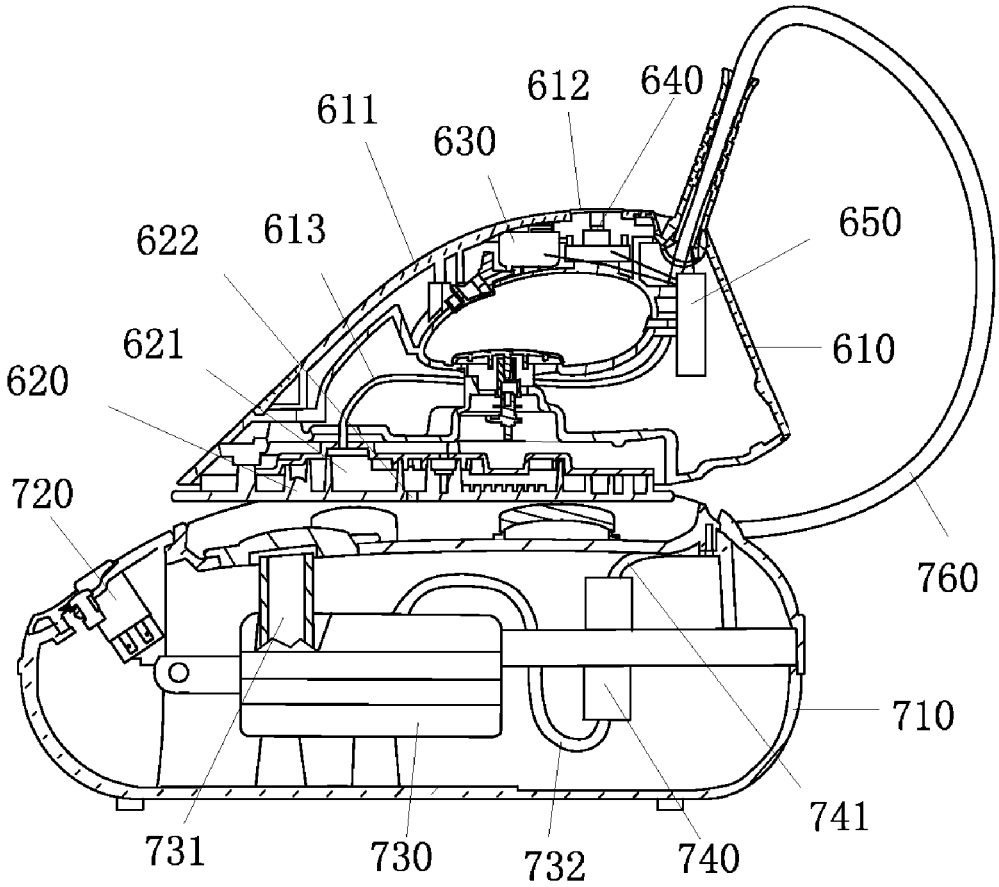
FIG. 4 is a sectional view of the steam iron in embodiment 4 of the present invention.

As is shown in FIG. 4, in this embodiment, the steam iron of the present invention is provided with an boiler ironing station, The lower portion of the housing 610 is provided with an electric heating plate 620. A power switch 630 is disposed on the handle 611 of the housing 610. The top surface of the handle 611 is provided with an opening and a cover 612 made of flexible material is dispose on the opening. A pressure sensor 640 is disposed beneath the opening in the handle 611. a control board 650 with microprocessor is disposed inside the housing 610 of the iron body.

A main switch 720, an electromagnetic valve 740 and a boiler are mounted inside the housing 710 of the iron station. The top of the boiler 730 is provided with an inlet 731; and a steam outlet tube 732 provided on the top of the boiler is connected to steam inlet of the electromagnetic valve 740. A tube 760 disposed between the iron station and the iron body contains a steam tube 613, a power cord and a signal cord inside. The steam tube 613 connected the steam outlet tube 741 of the electromagnetic valve 740 of the iron station with the vapor chamber 621 of the electric heating plate 620 of the iron body. The power cord provides power to the switch 630 of the iron body from the main switch 720 of the iron station. And the signal cord transmit the control signal from the control board 650 of the iron body to the electromagnetic valve 740 of the iron station.

A steam control device is consisted by the pressure sensor 640, control board 650 and the electromagnetic valve 740.

In ironing, if forceful steam is needed, the user can press the cover 612 disposed in the opening of the handle 611 by palm. Then the cover 612 is pressed downwardly to the pressure sensor 640, and the pressure sensor 640 will transmit a pressure signal of the pressing by the user to the control board 650, the electromagnetic valve 740 is controlled by the control board 650 according to the strength and the continue time of the signal, and input the steam in the boiler 730 to the vapor chamber 621 of the electric heating plate 620 to secondly heated so as to generate forceful steam, and the forceful steam is sprayed out from the outlet 622 of the electric heating plate 620.

The control board 650 provides voltage control signal to the electromagnetic valve 740, and the control board 650 will provide a strengthened voltage control signal to the electromagnetic valve 740 correspondingly if the pressure signal from the pressure sensor 640 is strengthened suddenly, so that more steam can be allowed through the electromagnetic valve 740 to the vapor chamber 621 of the electric heating plate 620 from the boiler 730, therefore the steam amount can be added in a short time to get forceful steam.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A steam iron comprising: a housing with a handle, a water container, a steam control device and a vapor chamber provided with a first electric heating plate, wherein said steam control device comprising a pressure sensor mounted on the handle of said housing, a control board with a microprocessor and a pump for providing the water into said vapor chamber; wherein said pump is controlled by said control board according to the pressure signal provided by said pressure sensor; and wherein said pump is disposed inside an iron station and provided with an inlet connected to said water container and an outlet connected to said electric heating plate; said pump pumps the water in said water container to a second electric heating plate of the iron body via a tube under the control of the control board.

2. A steam iron comprising: a water container, a vapor chamber provided with an electric heating plate, a housing with a handle and a steam control device, wherein said steam control device comprising a pressure sensor mounted on the handle of said housing, a control board with a microprocessor and an execution unit providing the vapor into said vapor chamber to be secondly heated and sprayed out; wherein said execution unit is controlled by said control board according to the pressure signal provided by said pressure sensor.

3. The steam iron according to claim 2, wherein said execution unit comprises a pump and an evaporator, said pump pumps the water into said evaporator under the control of the control board for generating the steam and then said steam is transported to said electric heating plate via the steam tube to be secondly heated and sprayed out.

4. The steam iron according to claim 3, wherein said pump, said evaporator and said water container are disposed in the iron station.

5. The steam iron according to claim 2, wherein said water container is a boiler and said execution unit is an electromagnetic valve, said electromagnetic valve transport the steam generated in said boiler to said electric heating plate via the steam tube under the control of the control board and the steam is secondly heated and sprayed out.

6. The steam iron according to claim 5, wherein said electromagnetic valve and said boiler are disposed inside said iron station.

* * * * *